US009199831B2

(12) United States Patent
Olsen et al.

(10) Patent No.: US 9,199,831 B2
(45) Date of Patent: Dec. 1, 2015

(54) DEFLECTION RESISTANT COMBINATION TURN PLATE AND SLIP PLATE

(71) Applicant: Hunter Engineering Company, St. Louis, MO (US)

(72) Inventors: Michael A. Olsen, Lake St. Louis, MO (US); William James Nelgner, St. Charles, MO (US); Timothy A. Strege, Sunset Hills, MO (US); Nicholas J. Colarelli, III, Creve Coeur, MO (US)

(73) Assignee: Hunter Engineering Company, St. Louis, MO (US)

( * ) Notice: Subject to any disclaimer, the term of this patent is extended or adjusted under 35 U.S.C. 154(b) by 351 days.

(21) Appl. No.: 13/788,467

(22) Filed: Mar. 7, 2013

(65) Prior Publication Data

US 2014/0166403 A1 Jun. 19, 2014

Related U.S. Application Data

(60) Provisional application No. 61/737,989, filed on Dec. 17, 2012, provisional application No. 61/763,145, filed on Feb. 11, 2013.

(51) Int. Cl.
*B66F 7/28* (2006.01)

(52) U.S. Cl.
CPC ..... *B66F 7/28* (2013.01)

(58) Field of Classification Search
CPC ..... B66F 7/28; B66F 7/065
USPC ..... 187/216, 217, 221; 248/349.1, 352
See application file for complete search history.

(56) References Cited

U.S. PATENT DOCUMENTS

| | | | | |
|---|---|---|---|---|
| 4,491,194 | A * | 1/1985 | Mountz | 187/204 |
| 6,209,209 | B1 * | 4/2001 | Linson et al. | 33/203.12 |
| 7,308,971 | B2 | 12/2007 | Liebetreu et al. | |
| 7,472,485 | B2 * | 1/2009 | Gray et al. | 33/203.14 |
| 8,590,852 | B2 | 11/2013 | Dantas et al. | |
| 2003/0098206 | A1 * | 5/2003 | Gallese | 187/216 |
| 2005/0133309 | A1 * | 6/2005 | Liebetreu et al. | 187/211 |
| 2006/0143931 | A1 * | 7/2006 | Jackson | 33/203.12 |
| 2006/0279728 | A1 * | 12/2006 | Dorrance et al. | 356/139.03 |
| 2011/0062303 | A1 * | 3/2011 | Dantas et al. | 248/346.03 |
| 2011/0063859 | A1 * | 3/2011 | Dantas | 362/459 |

OTHER PUBLICATIONS

The Sideslip Measurement: An Indication of Tire Wear Potential, Hunter Engineering Company, Form No. 2902T, Oct. 1990.

* cited by examiner

*Primary Examiner* — William A Rivera
*Assistant Examiner* — Michael Riegelman
(74) *Attorney, Agent, or Firm* — Polster Lieder

(57) ABSTRACT

A deflection resistant combination slip plate and turn plate assembly for support the steered wheels of a vehicle on a precision planar surface resistant to deflection and distortion. The slip plate and the turn plate are supported on an underlying surface by bearing assemblies, and establish a upper planar surface with the turn plate disposed in a cutout region of the slip plate. Each plate is configured for limited translational movement relative to the base plate surface on which it is supported, while the turn plate is further configured for rotational movement about a central axis. Translational movement of the plates is synchronized. Spacing between the slip plate and turn plate is minimized, and supporting means are provided to maintain the slip plate and turn plate in vertical alignment under load.

19 Claims, 8 Drawing Sheets

DEFLECTION RESISTANT COMBINATION TURN PLATE AND SLIP PLATE

CROSS-REFERENCE TO RELATED APPLICATIONS

The present application is related to, and claims priority from both U.S. Provisional Patent Application Ser. No. 61/737,989 filed Dec. 17, 2012, and U.S. Provisional Patent Application Ser. No. 61/763,145 filed Feb. 11, 2013, each of which is herein incorporated by reference.

STATEMENT REGARDING FEDERALLY SPONSORED RESEARCH

Not Applicable.

BACKGROUND OF THE INVENTION

The present invention relates generally to automotive service equipment incorporating vehicle wheel turn plates and slip plates, such as vehicle support systems and vehicle lift racks, and in particular, to a deflection resistant combination of a vehicle wheel turn plate and slip plate establishing a precision planar surface for receiving a vehicle steered wheel.

Typically, movable surfaces commonly referred to as turn plates and slip plates are placed on a vehicle support system surface onto which a vehicle undergoing an alignment measurement or adjustment procedure is disposed, such as a lift runway, as shown in FIGS. 1A and 1B. A turn plate is typically a round plate mounted on a bearing surface, flush with the surface of the vehicle support system. The turn plate permits the steered wheels of a stationary vehicle to be steered from side to side without requiring lifting of the vehicle, and simultaneously permits limited motion in a horizontal plane. A slip plate is similar in configuration, but is generally rectangular, and permits only motion in the horizontal plane, without permitting any rotational movement. These movable surfaces are commonly utilized in order to prevent the vehicle suspension from binding during movement of a vehicle required by an alignment adjustment or measurement process. Prior to driving a vehicle over the vehicle support surface, and at certain times before and during the measurement of a vehicle suspension system, these movable surfaces must be locked into position to prevent unintentional movement of the vehicle.

For example, during a conventional vehicle wheel alignment procedure, the vehicle is driven onto the vehicle support system with the movable surfaces in a locked configuration. Next, sensors are mounted to the vehicle wheels, and the sensors compensated before actual vehicle alignment measurements are acquired. The compensation procedure is required to eliminate errors in alignment angle measurements resulting from runout of the vehicle wheel, the wheel adaptor, or wheel alignment sensor mounting shaft, if present. The compensation procedure can be performed by rotating the vehicle wheels with the vehicle raised off the runway surface, or alternatively, by rolling the vehicle over a limited range on the runway surface with the wheel alignment sensors attached to the wheels, i.e. "rolling compensation"

To carry out the procedure for rolling compensation, it is required that the vehicle be rolled a short distance onto the turn plates, such as shown in U.S. Pat. No. 6,209,209 B1 to Linson et al., which is herein incorporated by reference. To carry out a short-distance variation of the procedure for rolling compensation, it is required that the vehicle be initially disposed with the front steered wheels approximately centered on the turn plates. The vehicle is then rolled forward a short distance, about 10-15 degrees, to the front edge of the turn plate, rolled back about 20-30 degrees, to the rear edge of the turn plate, and then rolled forward again to approximately the starting position on the turn plate. Measurements are acquired at multiple rotational positions of the vehicle wheels during this sequence.

Often, temporary devices are used to "bridge" the gaps which are present between the runway surfaces and the edges of each turn plate, permitting the vehicle to roll easier and have some support if the roll procedures carry the vehicle off either the front or rear edges of the turn plate. Following the compensation procedure, the bridges, if present, are removed to avoid interfering with the range of motion of the turn plate. The alignment measurements and any corrective procedures are then carried out in a conventional manner during which the movable surfaces may be locked into a stationary configuration from time to time as required, such as shown in U.S. Pat. No. 7,308,971 to Liebetreu et al., which is herein incorporated by reference.

During the rolling compensation procedures, measurements are acquired which are sensitive to movement of the vehicle suspension. In particular, it has been found that the rolling of the vehicle wheel assembly over the gap between the runway surface and the edge of the turn plate and/or slip plates can induce undesired reactions in the vehicle suspension system, and correspondingly, reduce the accuracy of measurements acquired during the rolling compensation procedures. Similar effects have been noted due to physical deflection of the turn plate surface away from a horizontal alignment due to an uneven distribution of weight from the vehicle as the vehicle wheel assemblies roll towards the respective forward and rear edges.

Accordingly, it would be advantageous to provide a vehicle support structure such as a floor, runway, or lift-rack surface with one or more turn plate/slip plate elements in a configuration which maintains a precision planar surface to within a measurement tolerance as a vehicle is driven across, and which reduces undesired reaction in the vehicle suspension system induced due to the presence of voids, gaps, or spaces in the vehicle's travel path.

BRIEF SUMMARY OF THE INVENTION

Briefly stated, the present disclosure sets forth a combination slip plate and turn plate assembly for support of the steered wheels of a vehicle on a precision planar surface. The assembly includes a common base plate on which both the slip plate and the turn plate are supported by associated bearing assemblies to establish a planar surface within an established measurement tolerance. The slip plate is configured for limited translational movement relative to the base plate surface on which it is supported, while the turn plate is configured for both limited translational movement relative to the base plate supporting surface and for rotational movement in the same plane about a central axis. Translational movement of the slip plate and turn plate relative to the base plate is synchronized by respective connections to a common tie bar disposed within a recessed portion of the base plate. The recessed portion is present in this embodiment to allow the assembly to sit on a flat surface. Alternatively the base plate may be spaced above a flat surface to eliminate the recess. If the assembly is placed on a lift surface an opening can be made in the lift surface to allow clearance for the tie bar. Spacing between the slip plate and turn plate is minimized by providing a longitudinal end of the slip plate with a concave curvature adapted to the radial dimension of the adjacent turn plate.

In a further embodiment, the combination slip plate and turn plate assembly includes at least one transverse cam bar disposed to selectively support the slip plate and turn plate against the base plate within a longitudinal region between adjacent bearing assemblies. The cam bar is selectively adjusted between a supporting state and a relaxed state. In the supporting state, the cam bar is rotated into engagement with the upper surface of the base plate and the lower surfaces of both the slip plate and turn plate, functioning as a rigid support member for distributing loads from the slip plate and turn plate to the base plate. In the relaxed state, the cam bar is rotated out of engagement with the lower surfaces of the slip plate and the turn plate, permitting interference-free translational movement of the respective plates.

In a further embodiment, the present disclosure sets forth an improved slip plate assembly for supporting the rear wheels of a vehicle on a precision planar surface. The slip plate is supported on a base plate by an array of bearings, and is configured for a limited range of translational and rotational movement within the plane of the precision surface by a guide pin and longitudinally spaced cam roller in engagement with the base plate. The guide pin extends vertically downward from the slip plate and into an open region defined by a notched portion of the base plate. Interaction between the guide pin and the peripheral edges of the notched region serve to define the limits of rotational and translational movement for the slip plate. Correspondingly, at the opposite longitudinal end of the slip plate from the guide pin, the cam roller is disposed below the underside surface of the slip plate, and is seated within a transverse slot in the base plate. The interaction between the cam roller and the transverse slot permits a limited range of lateral movement of the slip plate, while preventing longitudinal movement. A limited range of rotation motion of the slip plate about the axis of the cam roller within the transverse slot is regulated by the interaction between the guide pin and peripheral edge of the notched region in the base plate at the opposite longitudinal end of the slip plate.

In a further embodiment, the present disclosure sets forth a combination slip plate and turn plate assembly for support of the steered wheels of a vehicle on a precision planar surface in which the turn plate is disposed between opposite longitudinal ends of the slip plate. The assembly includes a common base plate on which both the slip plate and the turn plate are supported by associated bearing assemblies to establish a planar surface within an established measurement tolerance. The slip plate is configured for limited translational movement relative to the base plate surface on which it is supported, while the turn plate is configured for both limited translational movement relative to the base plate supporting surface and for rotational movement in the same plane about a central axis. Translational movement of the slip plate and turn plate relative to the base plate is synchronized by respective connections to a common tie bar disposed within a recessed portion of the base plate. Spacing between longitudinally forward and longitudinally rearward peripheral edges of the turn plate and the adjacent portions of the slip plate is minimized by providing the adjacent portions of the slip plate with concave curvature adapted to the radial dimension of the adjacent turn plate.

In a further embodiment, the combination slip plate and turn plate assembly includes at least two transverse cam bars disposed to selectively support the slip plate segments and the turn plate against the base plate within adjacent longitudinal regions between adjacent bearing assemblies. Each cam bar is selectively adjusted between a supporting state and a relaxed state. In the supporting state, each cam bar is rotated into engagement with the upper surface of the base plate and the lower surfaces of both the slip plate segment and turn plate, functioning as a rigid support member for distributing loads from the slip plate segment and turn plate to the base plate. In the relaxed state, the cam bar is rotated out of engagement with the lower surfaces of the slip plate and the turn plate, permitting interference-free translational movement of the respective plates.

In a further embodiment, the combination slip plate and turn plate assembly includes a set of retractable roller wheels disposed at each longitudinal end of the base plate. Each set includes at least two roller wheels mounted within a framework. The framework incorporates a lever mechanism to provide a cam action for selectively moving the roller wheels between a stationary position in which they are disengaged from the underlying surface on which the base plate is disposed, and a rolling position in which they are displaced downward into engagement with the surface, lifting the assembly. When in the rolling position, the roller wheels support the base plate sufficiently above the surface so as to permit the assembly to be repositioned in the rolling direction of the roller wheels. Once the assembly is disposed in the desired position, the lever mechanism is actuated to lower the base plate into contact with the surface and to return the roller wheels to the stationary position.

The foregoing features, and advantages set forth in the present disclosure as well as presently preferred embodiments will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings. It is to be understood that the drawings are for illustrating the concepts set forth in the present disclosure and are not to scale.

Figure 1A:
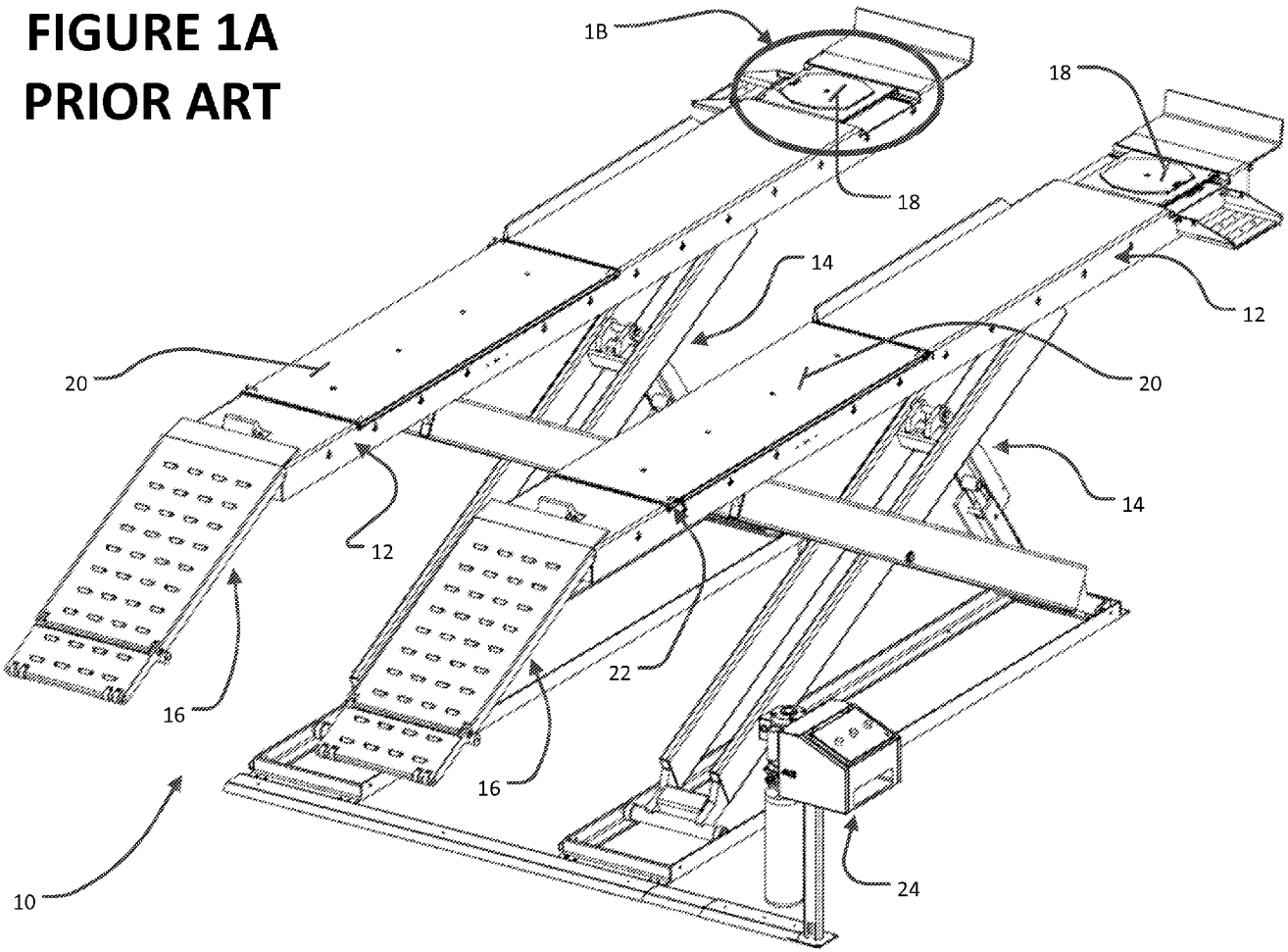
FIGURE 1A PRIOR ART
FIG. 1A is a perspective view of a prior art vehicle lift rack incorporating a set of slip plates and turn plates mounted in the runways.

Before any embodiments of the invention are explained in detail, it is to be understood that the invention is not limited in its application to the details of construction and the arrangement of components set forth in the following description or illustrated in the drawings.

DETAILED DESCRIPTION

The following detailed description illustrates the invention by way of example and not by way of limitation. The description enables one skilled in the art to make and use the present disclosure, and describes several embodiments, adaptations, variations, alternatives, and uses of the present disclosure, including what is presently believed to be the best mode of carrying out the present disclosure.

Figure 1B:
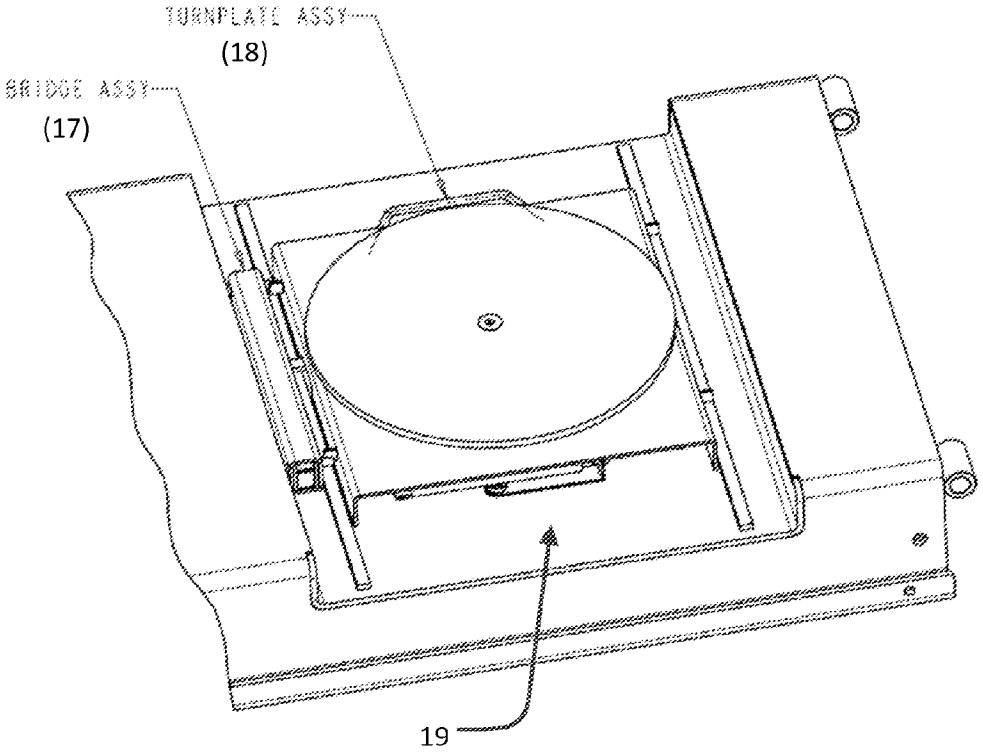
FIGURE 1B PRIOR ART
FIG. 1B is a close-up view of portion 1B of the prior art vehicle lift rack shown in FIG. 1A.

Turning to FIGS. 1A and 1B, a prior art vehicle support system is shown generally at 10. The vehicle support system 10 consists of an underlying surface, which may be for example, a supporting floor or an identical pair of adjacent runways 12, each configured to support the wheels for one side of a vehicle. Each runway 12 is optionally mounted on a lift structure 14, which forms no part of the present invention, such as a hydraulically actuated scissor mechanism. During use with runways, a vehicle is driven onto the runways 12 via a pair of inclined ramps 16 at the rear of the runways. The front vehicle wheels are driven over a bridge structure 17, stopped on conventional turn plates 18 at the front of the runways 12, and the rear vehicle wheels are disposed on conventional slip plates 20. While the vehicle is driven onto and over the turn plates 18 and the slip plates 20, the movable surfaces are locked in place manually by removable pins 22 coupling the movable surfaces to the rigid structure of the runways 12. The lift structures 14 are then actuated from a control console 24, simultaneously raising both runways 12 to a desired vehicle service height.

Those of ordinary skill in the art will recognize that a wide variety of vehicle support systems are known, such as, floor surfaces, but not limited to post lifts, side lifts, and floor-mounted runways. While the inventive aspects of the present invention are described below in connection with a vehicle support system having a pair of vertically movable adjacent runways, those of ordinary skill in the art will recognize that the inventive aspects of the present invention may be utilized with any type of vehicle support system, or alternatively, independently of a vehicle support system as portable movable surfaces onto which a vehicle may be driven.

Figure 2:
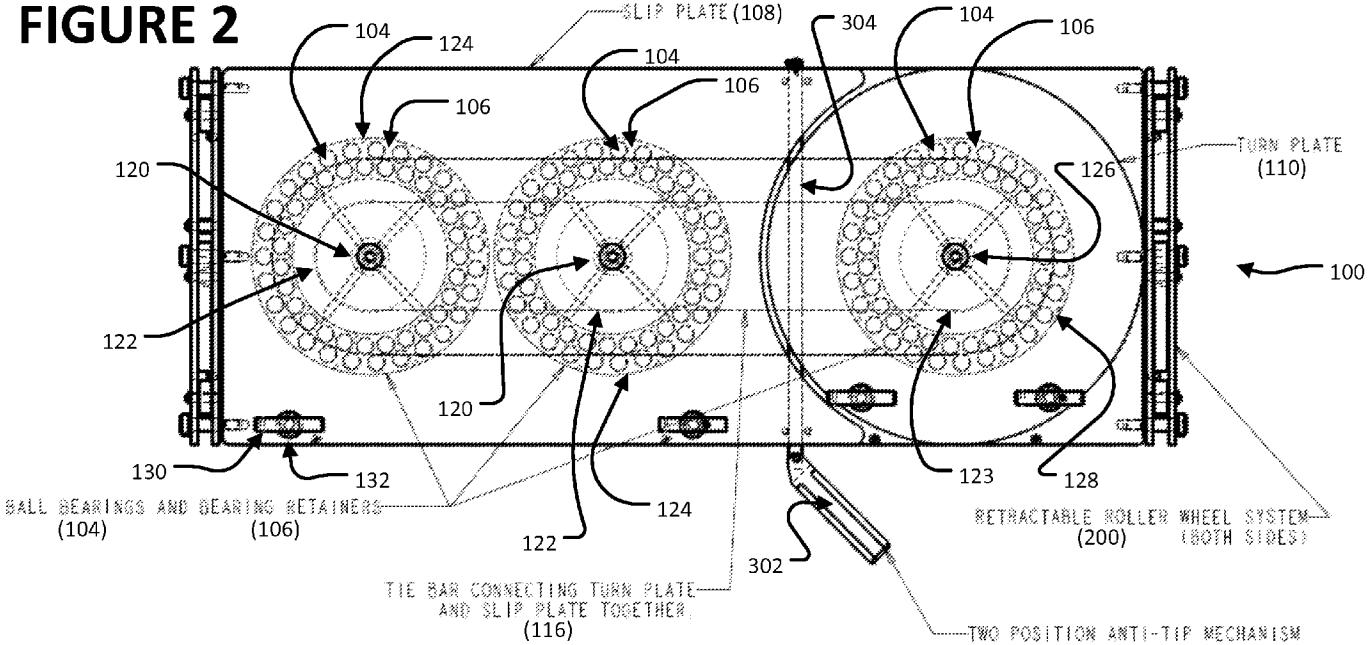
FIG. 2 is a top plan view of a combination slip plate/turn plate of the present disclosure.
Figure 3:
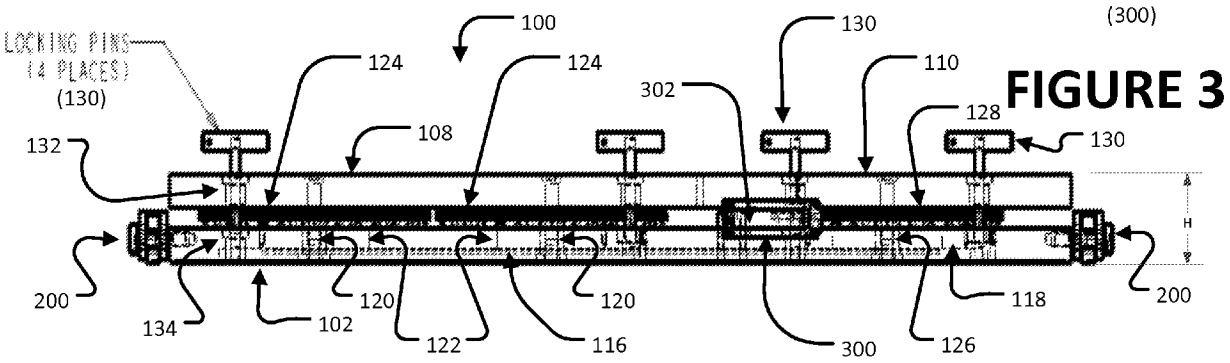
FIG. 3 is side plan view of the combination slip plate/turn plate of FIG. 2.

As shown in FIGS. 2 and 3, a combination turn plate/slip plate assembly 100 of the present invention may be employed on a runway 12 in place of the conventional bridge structure 17 and turn plate 18 to provide a precision planar surface. The combination turn plate/slip plate assembly 100 is typically disposed in a recessed region 19 adjacent the front end of the runway 12, in the anticipated position of the steered wheels of a vehicle parked on the runway 12. The recessed region 19 has a depth which closely corresponds to the vertical dimension (H) of the combination turn plate/slip plate assembly 100, such that a vehicle rolling onto the assembly 100 from the runway surface 12 does not experience vertical displacement in excess of an established measurement tolerance.

The assembly 100 in one embodiment comprises a base plate 102 having a generally rectangular configuration, and which is configured for placement within the recessed region 19 of the runway 12. Disposed above the base plate 102, and supported on assemblies 124 and 126 of ball bearings 104 held in place by associated retainers 106, is a slip plate 108 and a turn plate 110. The slip plate 108 is generally rectangular in configuration, incorporating a semi-circular cut-out 112 at a longitudinal end, adjacent to the turn plate 110. The semi-circular cut-out 112 has a radius which is coaxial with, and slightly greater than, the radius of the turn plate 110, such that an arcuate gap 114 is present between the slip plate 108 and turn plate 110. The size of the arcuate gap 114 is sufficient to maintain clearance between the slip plate 108 and turn plate 110 without inducing undesired vertical movement in the suspension system of a vehicle as it is rolled from the slip plate 108 onto the turn plate 110. While shown in the Figures and described herein as having an arcuate shape or semi-circular shape to conform with the circumferential edge of the turn plate 110, those of ordinary skill in the art will recognize that the shape and size of the gap 114 need not be so limited, and may assume any configuration which has dimensions smaller than that which would be capable of inducing an undesired amount of vertical movement in a traversing vehicle wheel or capable of inducing an amount of vertical movement in a traversing vehicle wheel which exceeds a measurement tolerance.

As best seen in FIG. 2, the slip plate 108 and turn plate 110 are linked together for common translational movement in a horizontal plane by a horizontal tie bar 116 disposed within a longitudinally elongated recess 118 in the lower surface of the base plate 102. To couple the slip plate 108 to the tie bar 116, a pair of laterally centered and longitudinally aligned vertical posts or bolts 120 pass through associated enlarged openings 122 in the base plate. Each vertical post or bolt 120 further serves to couple an associated bearing assembly 124 in place between the slip plate and the upper surface of the base plate 102. The dimensions of the recess 118 and the diameter of the openings 122 in the base plate 102 are selected to permit the desired range of translational movement in the horizontal plane by the slip plate 108, with engagement between the vertical posts or bolts 120 and the inner circumferential edge of the openings 122 defining the limits of the translational movement for the slip plate.

The turn plate 110 is similarly coupled to the common tie bar 116 by a single vertical post or bolt 126 which is coaxial with the center of the circular turn plate 110, and which passes through an associated laterally centered oversize opening 123 in the base plate. The vertical post or bolt 126 further serves to couple an associated bearing assembly 126 in place between the turn plate and upper surface of the base plate 102. The dimensions of the opening 123 in the base plate 102 correspond with the dimensions of the openings 122, and are selected to permit the same range of translational movement in the horizontal plane by the turn plate 110 as is permitted for the slip plate 108, with engagement between the vertical posts or bolts 126 and the inner circumferential edge of the opening 123 defining the limit of the translational movement for the turn plate 110. In addition to having a freedom of movement in the horizontal plane, the turn plate 110 is configured to freely to rotate about a vertical axis of the vertical post or bolt 126.

Translational movement in the horizontal plane of the slip plate 108 and the turn plate 110 is maintained in lock-step unison by the associated connections to the tie bar 116. During some steps in a vehicle service procedure, it is preferred that the slip plate 108 and turn plate 110 be locked in place and restrained from translational movement in the horizontal plane. Locking pins 130 may be inserted into receiving bores 132 in the slip plate 108 and turn plate 110 to engage aligned bores 134 in the base plate 102 when the slip plate 108 and turn plate 110 are disposed at a lock position. With the locking pins 130 in place, translational movement of both the slip plate and the turn plate is prevented. Similarly, the turn plate 110 can be restrained from rotational movement about the vertical axis of the post or bolt 126 with the placement of locking pins 130 into the receiving bores 132 associated there with for engagement with correspondingly aligned bores 134 in the base plate 102.

Those of ordinary skill will recognize that with alternate configurations, the slip plate 108 and turn plate 110 may be configured as independent elements positioned directly onto an underlying support surface in adjacent proximity without the use of a common base plate 102. When configured as independent elements, a suitable mechanism such as the common tie bar 116 is utilized to ensure translational movement of the slip plate 108 and turn plate 110 in the horizontal plane is maintained in lock-step unison.

Figure 4:
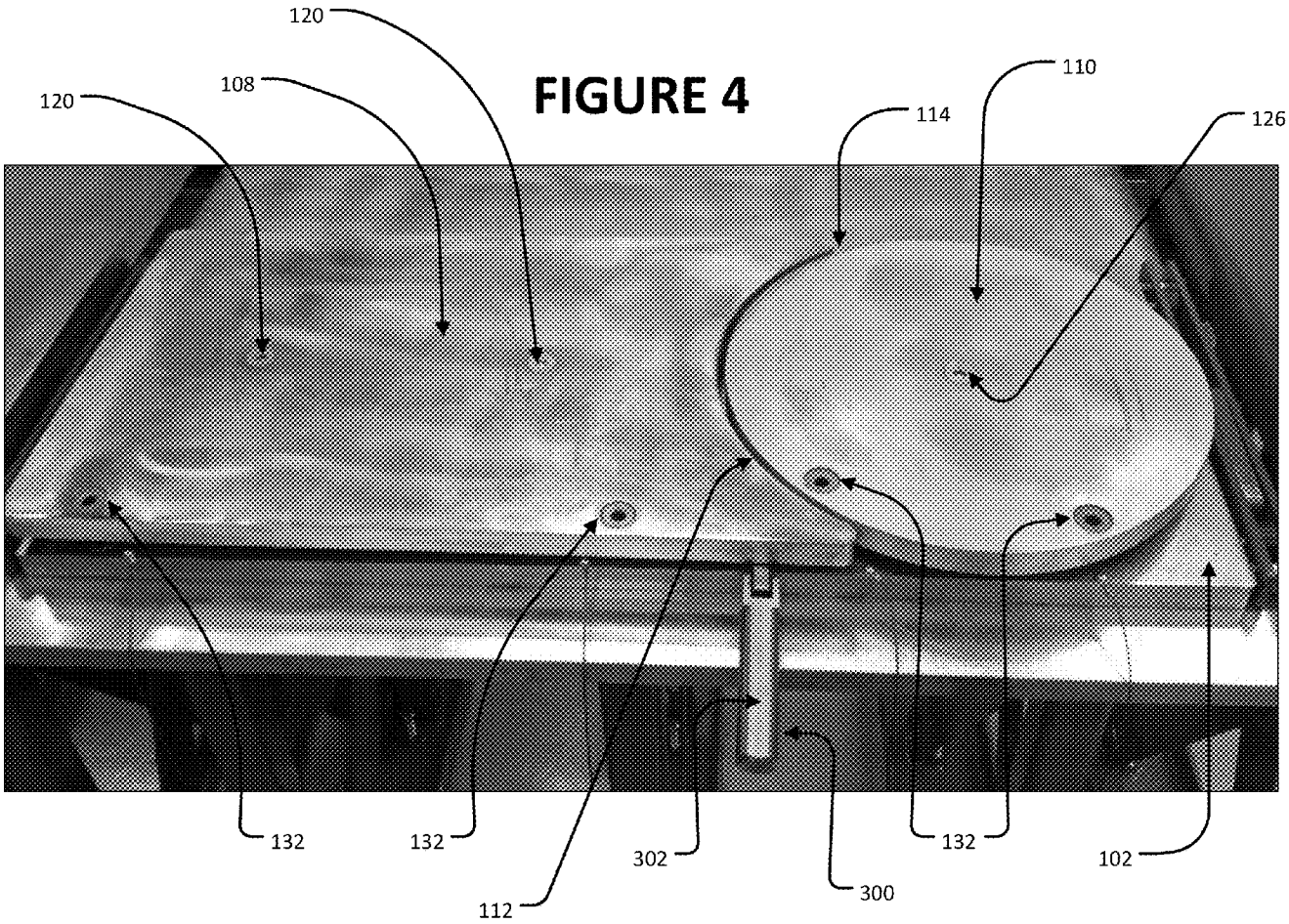
FIG. 4 is perspective view of the combination slip plate/turn plate of FIG. 2.
Figure 5:
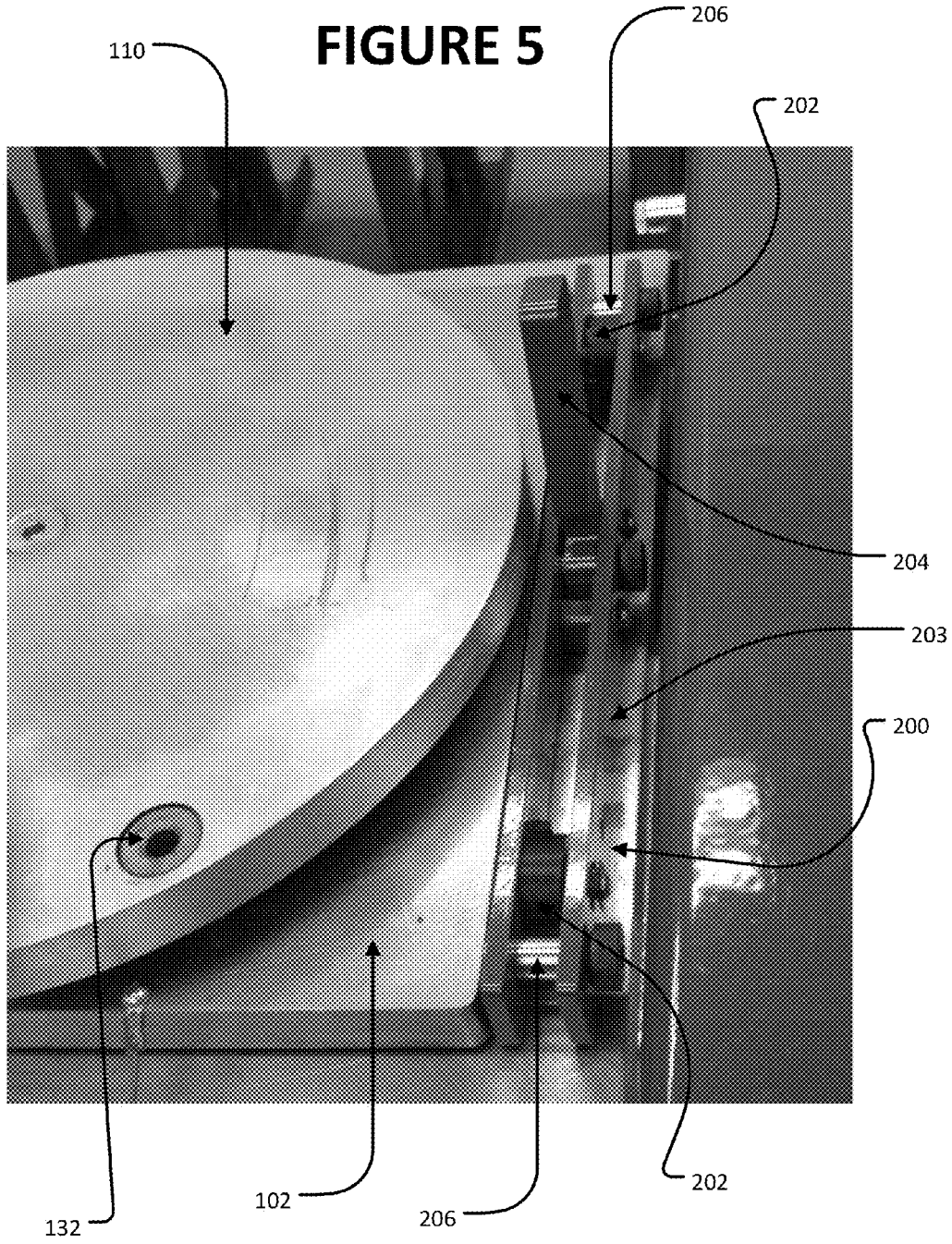
FIG. 5 is perspective view of a retractable roller assembly for facilitate positioning of the combination slip plate/turn plate of FIG. 2.

During a vehicle service procedure, or in preparation for a vehicle service procedures, repositioning of an assembly 100 within the recessed region 19 of the runway 12 may be required. To facilitate repositioning of the complete assembly of the slip plate 108 and turn plate 110 disposed over the base plate 102 within the recessed region 19 of the runway 12, a movement mechanism 200 such as a set of retractable roller wheels is optionally disposed at each longitudinal end of the base plate 102. As shown in the Figures, the movement mechanism 200 includes at least two roller wheels 202 mounted within a framework 203 which is secured to the base plate 102 by bolts 206 or other suitable attachment means. As best seen in FIGS. 2 and 5, the framework 203 incorporates a lever mechanism 204 which provides a cam action to move the roller wheels 202 between a stationary position in which they are disengaged from the surface of the recessed region 19, and a rolling position in which they are displaced downward into engagement with the surface of the recessed region 19, lifting the base plate 102 of the assembly 100. When in the rolling position, the roller wheels 202 support the base plate 102 sufficiently above the surface of the recessed region 19 in the runway to permit the base plate 102 to be repositioned in the rolling direction of the roller wheels 202. Once the base plate 102 is disposed in the desired position, the lever mechanism 204 is actuated to lower the base plate 102 into contact with the surface of the recessed region 19 and to return the roller wheels 202 to the stationary position. With the roller wheels in the stationary position, the lever mechanism 204 is disposed at or below the plane of the upper surface of the slip plate 108 and turn plate 110, as seen in FIG. 4, so as to avoid interference with any traversing vehicle wheels.

Although the roller wheels 202 illustrated in FIGS. 2 and 5 are limited to rolling movement laterally relative to the longitudinal dimension of the assembly 100, it will be recognized that the specific configuration of the movement mechanism 200 may be modified as necessary to facilitate movement of the assembly 100 in additional or alternate directions without departing from the scope of the present disclosure, including the addition of additional roller wheels or use of alternative mechanisms. Generally, traditional turn plates do not require a movement mechanism, but such is preferred to position the turn plate/slip plate assembly 100 of the present disclosure on the underlying surface due to weight. Those of ordinary skill in the art will recognize that other movement mechanisms 200 may be used to position the assembly as well without departing from the scope of the present disclosure. These may include, for example, a lever mechanism, a manually operated screw mechanism, or pneumatic or hydraulic actuators. If a powered system is provided, it may not be necessary to elevate the turn plate/slip plate assembly 100 from the underlying support structure.

As a vehicle wheel assembly traverses across the surface of the runway 12, and onto the slip plate 108 and turn plate 110 of the assembly 100, a portion of the vehicle's weight must be supported by the assembly. Accordingly, the various components of the assembly 100 must be of sufficient structural strength, or receive necessary reinforcing support, to accommodate anticipated vehicle loads without deflecting or distorting from the unloaded plane by more than a permissible measurement tolerance. As best seen in FIG. 2, the bearing assemblies 124 supporting the slip plate 108 are disposed in close proximity, such that they provide substantially continuous support for the slip plate 108 in the longitudinal direction. However, the bearing assembly 128, which supports the turn plate 110 is longitudinally spaced from the closest bearing assembly 124, such that a longitudinal end portion of the slip plate 108 and an adjacent radially outward portion of the turn plate 110 are relatively unsupported against vertical deflection by the respective bearing assemblies.

To accommodate vehicle loads without deflection or distortion of the slip plate 108 or turn plate 110 in this region of the assembly 100, and to maintain the slip plate 108 and turn plate 110 in vertical alignment, a support means such as a two-position anti-tip mechanism 300 is disposed laterally across the upper surface of the base plate 102 between the bearing assembly 124 and bearing assembly 128. The anti-tip mechanism includes an external handle or actuator 302 which is coupled to a laterally extending cam bar 304 laterally traversing the upper surface of the base plate 102 as shown in FIG. 2. The cam bar 304 has a cross sectional profile with a short crosswise dimension being less than a height of the bearing assemblies 124 and 128, and a long crosswise dimension being equal to the height of the bearing assemblies 124 and 128. Rotating the actuator 302 correspondingly rotates the cam bar 304 between a supporting position in which the long crosswise dimension is vertically aligned, and a relaxed position in which the long crosswise dimension is rotated away from the vertical alignment. When in the supporting position, the cam bar 304 functions as a rigid support extending laterally across the upper surface of the base plate 102, supporting the longitudinal end portion of the slip plate 108 and the adjacent radially outward portion of the turn plate 110 between the bearing assembly 124 and the bearing assembly 126 against distortion or deflection under load. In the relaxed position, the cam bar 304 rests freely between the base plate 102, the slip plate 108, and the turn plate 110, avoiding interference there with during translational and rotational movements. It will be recognized that specific construction of the cam bar 304 can be replaced by other support means to achieve the same functionality. For example, a supporting bar can be slid up a ramp by pulling on a lever or turning a screw, two parallel bars can be connected by a parallelogram linkage and actuated by a lever or a screw. Alternatively, a support means can be selectively raised by powered actuators, where the actuators are screws or pneumatic or hydraulic cylinders.

It will be recognized that by varying the structural materials, size and placement of the bearing assemblies 124 and 126, or by including additional bearing assemblies between the surfaces of the base plate 102, slip plate 108, and turn plate 110, it may be possible to alter or eliminate the two-position anti-tip mechanism 300 and still maintain the desired level tolerance for the assembly 100 under load. Alternatively more than one anti-tip mechanism 300 may be provided between the base plate 102 and the slip plate 108 and/or turn plate 110, depending upon the particular dimensions, structural rigidity, and precision tolerances of the assembly 100.

While a combination slip plate and turn plate assembly 100 is best suited for use with the steerable wheels of a vehicle undergoing service, the unsteered or rear wheels of a vehicle typically only require a slip plate assembly to prevent unintended forces from being transferred through the vehicle wheel assembly to the vehicle suspension components during a vehicle service procedure. In a further embodiment, the present disclosure provides a slip plate assembly 400 which is configured to provide a precision planar surface. The slip plate assembly 400 is typically disposed in a recessed region adjacent to a rear end of the runway 12, in the anticipated position of the rear or unsteered wheels of a vehicle parked on the runway 12. A vertical dimension (V) for the turn plate assembly 400 corresponds to the vertical depth of the recessed region in which the slip plate assembly is disposed, such that the slip plate assembly upper surface and the adjacent surfaces of the runway are in planar alignment to within an established measurement tolerance. With the slip plate assembly upper surface aligned with the runway surfaces, a vehicle rolling onto the assembly 400 from the runway surface 12 does not experience vertical displacement in excess of an established measurement tolerance.

Figure 6:
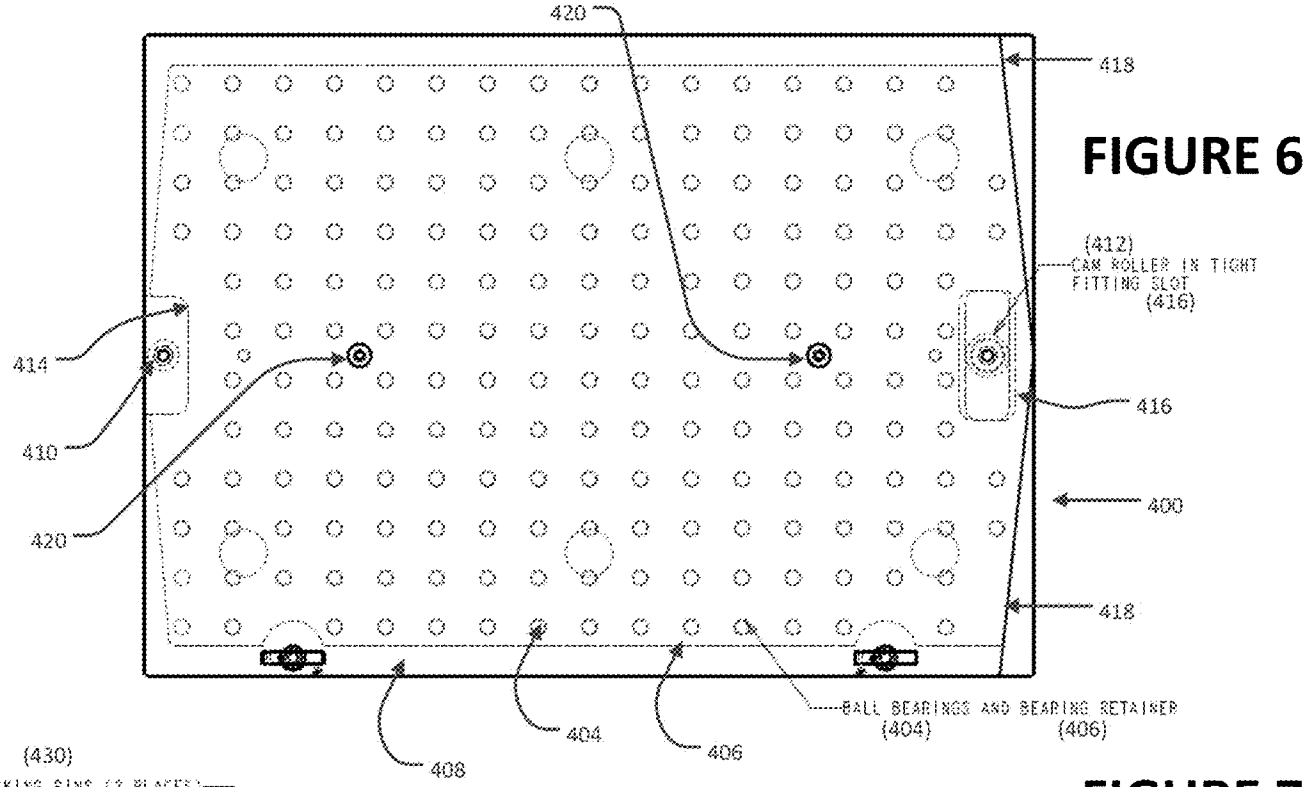
FIG. 6 is top plan view of a rear wheel slip plate of the present disclosure.
Figure 7:
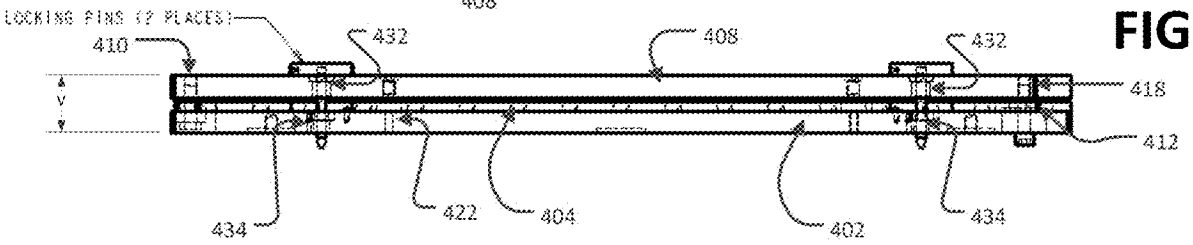
FIG. 7 is a side plan view of the rear wheel slip plate of FIG. 6.

As best seen in FIGS. 6 and 7, the assembly 400 comprises a base plate 402 having a generally rectangular configuration. Disposed above the base plate 402, and supported on at least one array of ball bearings 404 held in place by an associated retainer 406, is a slip plate 408. Translational and rotational movement of the slip plate 408 in the horizontal plane is limited by a guide pin 410 and a cam roller 412 which extend vertically from the slip plate 408 and interact the base plate 402. The guide pin 410 and the cam roller 412 are disposed on the longitudinal centerline of the slip plate 408, with the guide pin 410 adjacent to the rearward edge of the slip plate, and the cam roller 412 adjacent to the forward edge of the slip plate. The guide pin 410 is seated flush with the upper surface of the slip plate 408, and extends vertically downward through a bore, and into a receiving region defined by a notch 414 in the rearward edge of the base plate 402. The notch 414 is sized to permit the guide pin 410 to move freely within the receiving region as the slip plate 408 moves horizontally within the permitted range of movement. Interaction between the guide pin 410 and the peripheral edges of the notch 414 serves to limit the permitted range of movement for the slip plate 408.

At the opposite longitudinal end of the slip plate 408, the cam roller 412 is coupled adjacent the underside surface of the slip plate 408 by a recessed bolt or other suitable coupling means which extends through the slip plate 408. The cam roller 412 is further seated within a transversely aligned slot 416 in the base plate 402, such that it has a limited range of permitted transverse (left-right) movement, but is restrained against movement in the longitudinal (front-rear) direction. A limited range of rotational movement of the slip plate 408 about the vertical axis of the cam roller 412 is permitted, but is limited by the interaction of the guide pin 410 with the edges of the notch 414 at the opposite longitudinal end of the slip plate 408. To further facilitate the limited rotational movement of the slip plate 408 relative to the base plate 402, portions of the front and/or rear edges of the slip plate may be resected as needed, such as seen at 418 in FIG. 6, to avoid interference with adjacent structures of the runway 12.

During some steps in a vehicle service procedure, it is preferred that the slip plate 408 be locked in place and restrained from both translational and rotational movement in the horizontal plane. Locking pins 430 may be inserted into receiving bores 432 in the turn plate 408 to engage aligned bores 434 in the base plate 402 when the slip plate 408 is disposed at a lock position. With the locking pins 430 in place, translational and rotational movement of the slip plate is prevented. A semi-permanent locking of the slip plate 408 to the base plate 402, such as for transportation purposes, can be achieved by threading bolts through bores 420 in the slip plate into aligned threaded bores 422 in the base plate 402. If the bolts are provided with eyelets (not shown), they may be utilized as connection points for a hoist or crane to lift and move the slip plate assembly 400.

Figure 8:
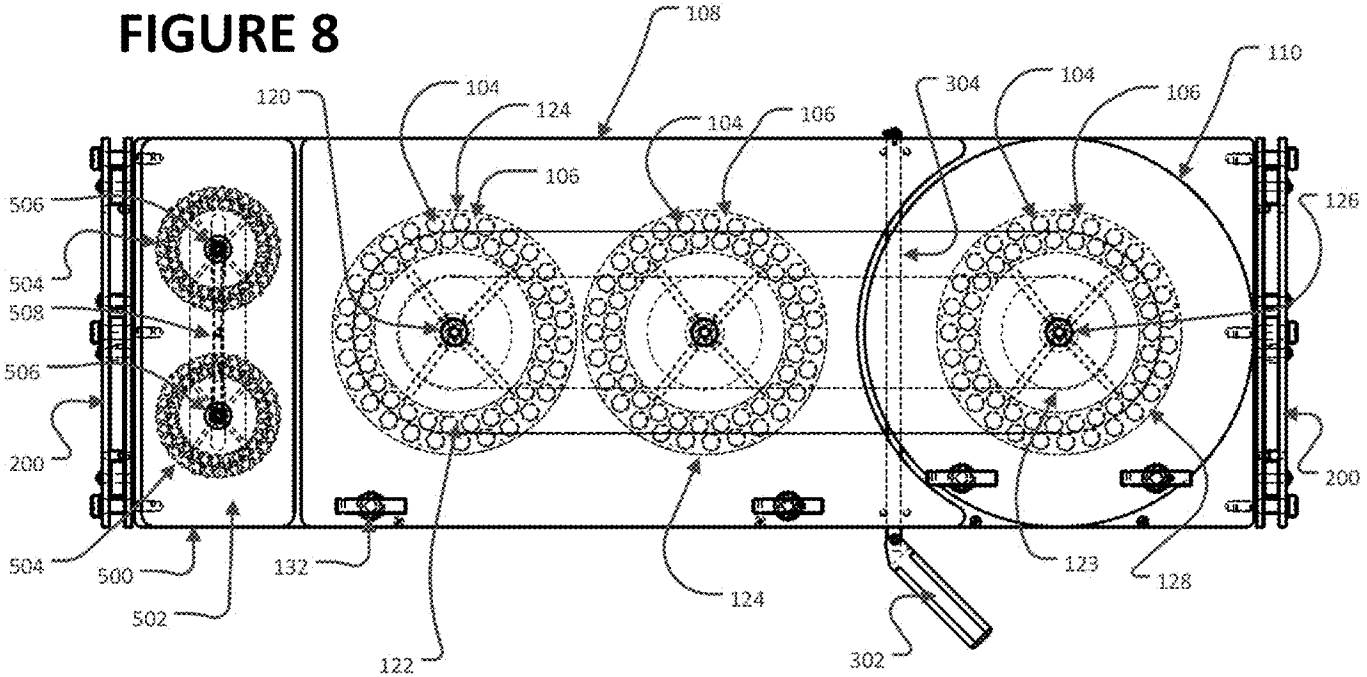
FIG. 8 is a top plan view of an alternate combination slip plate/turn plate of the present disclosure incorporating a side-slip plate.
Figure 9:
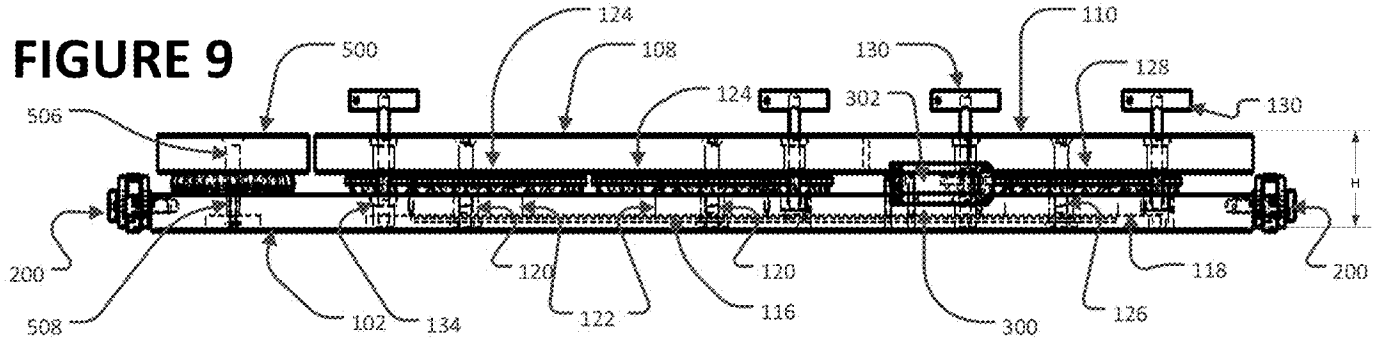
FIG. 9 is side plan view of the combination slip plate/turn plate of FIG. 8.

For some applications, it is desired to relieve lateral loads from the vehicle wheels prior to rolling onto a combination slip plate/turn plate of the present disclosure. As shown in FIGS. 8 and 9, a sideslip plate 500 configured for lateral movement relative to the longitudinal direction of vehicle travel may be disposed adjacent to one end of the slip plate 108, longitudinally opposite from the turn plate 110 in a combination slip plate/turn plate assembly 100. If the turn plate/slip plate assembly 100 is configured with a movement mechanism 200 disposed at the longitudinal end, the sideslip plate 500 may be disposed between the slip plate 108 and the movement mechanism 200. As a vehicle passes over the sideslip plate 500, lateral forces exerted by the vehicle wheel can be relieved by lateral movement of the sideslip plate 50. A detailed description of sideslip principals and their effect on vehicle wheel assemblies can be found in the Hunter Engineering Company technical publication "The Sideslip Measurement: An indication of Tire Wear Potential", published in October of 1990 as Hunter Engineering Co. form No. 2902T, and in U.S. Pat. No. 6,209,209 B1 to Linson et al., both of which are herein incorporated by reference.

As shown in the Figures, the sideslip plate 500 is configured with an upper plate 502 positioned above an underlying surface, such as the base plate 102 of the assembly 100. The upper plate 502 rests on a set of bearing assemblies 504, and is constrained for movement only in the lateral direction by an arrangement of guide pins 506 and a laterally transverse slot 508. Those of ordinary skill in the art will recognize that a variety of different configurations for the sideslip plate 500 may be utilized without departing from the scope of the present invention. For example, the sideslip plate 500 may be fully independent from the assembly 100, and suitably integrated into the vehicle support surface such as a runway or lift rack.

Figure 10:
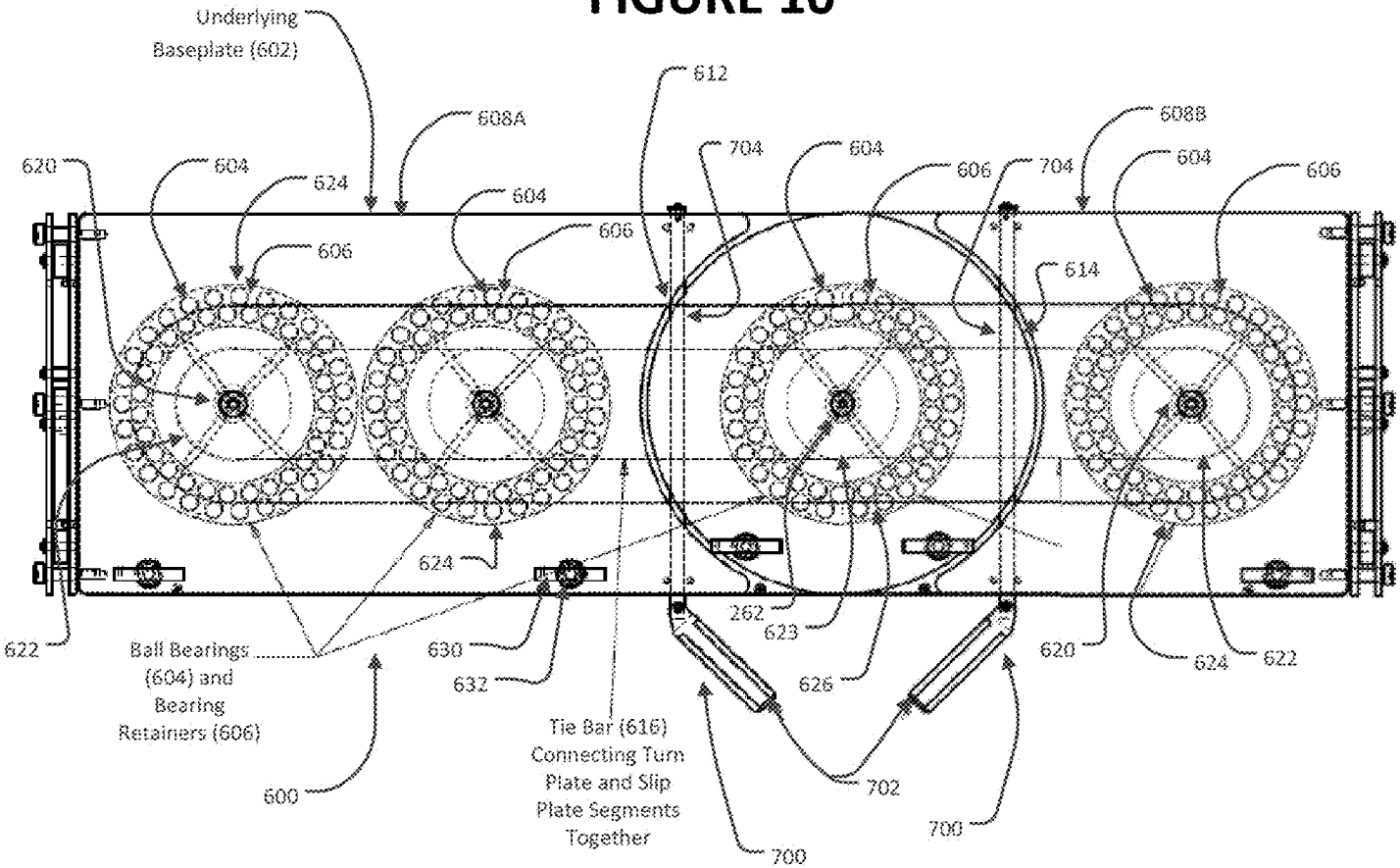
FIG. 10 is a top plan view of a further embodiment of the combination deflection resistant slip plate/turn plate of the present disclosure.

As shown in FIG. 10 an embodiment 600 of the deflection resistant combination turn plate/slip plate assembly of the present invention may be employed on a runway 12 in place of the conventional bridge structure 17 and turn plate 18 to provide a precision planar surface. The combination turn plate/slip plate assembly 600 is typically disposed in a recessed region 19 adjacent the front end of the runway 12, in the anticipated position of the steered wheels of a vehicle parked on the runway 12. The recessed region 19 has a depth which closely corresponds to the vertical dimension (H) of the combination turn plate/slip plate assembly 600, such that a vehicle rolling onto the assembly 600 from the runway surface 12 does not experience vertical displacement in excess of an established measurement tolerance.

The assembly 600 in one embodiment comprises a base plate 602 having a generally rectangular configuration, and which is configured for placement within the recessed region 19 of the runway 12. Disposed above the base plate 602, and supported on assemblies 624 and 628 of ball bearings 604 held in place by associated retainers 606, is a slip plate structure 608 and a turn plate 610. The slip plate structure 608 is generally rectangular in configuration, defining a fore slip plate 608A (onto which a vehicle first rolls when moving across the assembly 600 in a forward longitudinal direction) and an aft slip plate 608B, and incorporating a circular cut-out region 612 between the fore and aft slip plates for receiving a turn plate 610. The circular cut-out 612 has peripheral edges with a radius which is coaxial with, and slightly greater than, the radius of the turn plate 610, such that an arcuate gap 614 is present between the slip plate structure 608 and circumferential edge of the turn plate 610. The size of the arcuate gap 614 is sufficient to maintain clearance between the slip plate structure 608 and turn plate 610 without inducing undesired movement in the suspension system of a vehicle as it is rolled from either the fore slip plate 608A or the aft slip plate 608B onto the turn plate 610. As shown in FIG. 10, the circular cut-out 612 may be discontinuous, intersecting the lateral edges of the slip plate, so as to separate the fore and aft slip plates 608A, 608B of the slip plate structure 608 into two separate segments, with the turn plate 610 disposed there between. Alternatively, if the slip plate structure has a lateral dimension (width) which is sufficiently greater than the diameter of the turn plate, the turn plate 610 may be fully enclosed within the circular cut-out 612, and the fore and aft slip plates coupled together as a continuous structure.

As best seen in FIG. 10, the fore and aft slip plates 608A, 608B, and the turn plate 610 may be linked together for common translational movement in a horizontal plane by a horizontal tie bar 616 disposed within a longitudinally elongated recess 618 in the lower surface of the base plate 602. To couple the slip plates 608A and 608B to the tie bar 616, a set of laterally centered and longitudinally aligned vertical posts or bolts 620 pass through associated enlarged openings 622 in the base plate. Each vertical post or bolt 620 further serves to couple an associated bearing assembly 624 in place between the slip plate structure and the upper surface of the base plate 602. The dimensions of the recess 618 and the diameter of the openings 622 in the base plate 602 are selected to permit the desired range of translational movement in the horizontal plane by the slip plate structure 608, with engagement between the vertical posts or bolts 620 and the inner circumferential edge of the openings 622 defining the limits of the translational movement for the slip plate structure.

The turn plate 610 is similarly coupled to the common tie bar 616 by a single vertical post or bolt 626 which is coaxial with the center of the circular turn plate 610, and which passes through an associated laterally centered oversize opening 623 in the base plate. The vertical post or bolt 626 further serves to couple an associated turn plate bearing assembly 628 in place between the turn plate and upper surface of the base plate 602. The dimensions of the opening 623 in the base plate 602 correspond with the dimensions of the openings 622, and are selected to permit the same range of translational movement in the horizontal plane by the turn plate 610 as is permitted for the slip plate structure 608, with engagement between the vertical posts or bolts 626 and the inner circumferential edge of the opening 623 defining the limit of the translational movement for the turn plate 610. In addition to having a freedom of movement in the horizontal plane, the turn plate 610 is configured to freely to rotate about a vertical axis of the vertical post or bolt 626.

Preferably, translational movement in the horizontal plane of the slip plates 608A, 608B, and the turn plate 610 is maintained in lock-step unison by the associated connections to the tie bar 616. During some steps in a vehicle service procedure, it is preferred that the slip plate structure 608 and turn plate 610 be locked in place and restrained from translational movement in the horizontal plane. Locking pins 630 may be inserted into receiving bores 632 in the slip plate structure 108 and turn plate 610 to engage aligned bores 634 in the base plate 602 when the slip plate structure 608 and turn plate 610 are disposed at a lock position. With the locking pins 630 in place, translational movement of both the slip plate structure and the turn plate is prevented. Similarly, the turn plate 610 can be restrained from rotational movement about the vertical axis of the post or bolt 626 with the placement of locking pins 630 into the receiving bores 632 associated there with for engagement with correspondingly aligned bores 634 in the base plate 602.

Those of ordinary skill will recognize that with alternate configurations, the slip plate structure 608, including either the fore slip plate 608A or the aft slip plate 608B, and turn plate 610 may be configured as independent elements positioned directly onto an underlying support surface in adjacent proximity without the use of a common base plate 602. When configured as independent elements, a suitable mechanism such as the common tie bar 616 may be utilized to ensure translational movement of the slip plate structure 608 and turn plate 610 in the horizontal plane is maintained in lock-step unison. Alternatively, it may be desirable to permit either or both the fore slip plate 608A or the aft slip plate 608B to have translational movement which is independent of either the other slip plate components or the turn plate. Suitable modifications to, or elimination of, the tie bar 616 may be made to accommodate such configurations without departing from the scope of the present disclosure.

During a vehicle service procedure, or in preparation for a vehicle service procedures, repositioning of an assembly 600 within the recessed region 19 of the runway 12 may be required. To facilitate repositioning of the complete assembly of the slip plate structure 608 and turn plate 610 disposed over the base plate 602 within the recessed region 19 of the runway 12, a movement mechanism such as a set of retractable roller wheels is optionally disposed at each longitudinal end of the base plate 602. As shown in the Figures, the movement mechanism includes at least two roller wheels mounted within a framework which is secured to the base plate 602 by bolts or other suitable attachment means. As best seen in FIG. 10, the framework incorporates a lever mechanism which provides a cam action to move the roller wheels between a stationary position in which they are disengaged from the surface of the recessed region 19, and a rolling position in which they are displaced downward into engagement with the surface of the recessed region 19, lifting the base plate 602 of the assembly 100. When in the rolling position, the roller wheels support the base plate 602 sufficiently above the surface of the recessed region 19 in the runway to permit the base plate 602 to be repositioned in the rolling direction of the roller wheels. Once the base plate 602 is disposed in the desired position, the lever mechanism is actuated to lower the base plate 602 into contact with the surface of the recessed region 19 and to return the roller wheels to the stationary position. With the roller wheels in the stationary position, the lever mechanism is disposed at or below the plane of the upper surface of the slip plate 608 and turn plate 610, so as to avoid interference with any traversing vehicle wheels.

Although the roller wheels illustrated in FIG. 10 are limited to rolling movement laterally relative to the longitudinal dimension of the assembly 600, it will be recognized that the specific configuration of the movement mechanism may be modified as necessary to facilitate movement of the assembly 600 in additional or alternate directions without departing from the scope of the present disclosure, including the addition of additional roller wheels or use of alternative mechanisms. Generally, traditional turn plates do not require a movement mechanism, but such is preferred to position the turn plate/slip plate assembly 600 of the present disclosure on the underlying surface due to weight. Those of ordinary skill in the art will recognize that other movement mechanisms may be used to position the assembly as well without departing from the scope of the present disclosure. These may include, for example, a lever mechanism, a manually operated screw mechanism, or pneumatic or hydraulic actuators. If a powered system is provided, it may not be necessary to elevate the turn plate/slip plate assembly 600 from the underlying support structure.

As a vehicle wheel assembly traverses across the surface of the runway 12, and onto the slip plate structure 608 (in particular the fore slip plate 608A) and eventually onto the turn plate 610 of the assembly 600, or further forward onto the aft slip plate 608B, a portion of the vehicle's weight must be supported by the assembly. Accordingly, the various components of the assembly 600 must be of sufficient structural strength, or receive necessary reinforcing support, to accommodate anticipated vehicle loads without deflecting or distorting from the unloaded plane by more than a permissible measurement tolerance. For example, during a short-distance rolling compensation procedure, the vehicle is initially disposed with the front steered wheels approximately centered on the turn plates 610, the vehicle is then rolled forward a short distance, about 10-15 degrees, to the front edge of the turn plate 610 and/or onto the aft slip plate 608B, rolled back about 20-30 degrees, to the rear edge of the turn plate 600 and/or onto the fore slip plate 608A, and then rolled forward again to approximately the starting position on the turn plate 610.

Since measurements are acquired at multiple rotational positions of the vehicle wheels during this sequence, maintaining a uniform surface for the vehicle rolling movement without deflection or distortion by more than the permissible measurement tolerance is necessary. As best seen in FIG. 10, the turn plate bearing assembly 628, which supports the turn plate 610 is longitudinally spaced from the closest bearing assembly 624, such that an adjacent portion of the slip plates 608A, 608B, and adjacent radially outward portions of the turn plate 610 are relatively unsupported against vertical deflection by the respective bearing assemblies. To accommodate vehicle loads without deflection or distortion of the slip plates 608A, 608B, or turn plate 610 in these regions of the assembly 600, and to maintain the slip plate structure and turn plate 610 in vertical alignment, support means such as a two-position anti-tip mechanism 700 is disposed laterally across the upper surface of the base plate 602 between the bearing assembly 628 and each longitudinally adjacent bearing assembly 624 supporting the slip plate structure. Each anti-tip mechanism includes an external handle or actuator 702 which is coupled to a laterally extending cam bar 704 laterally traversing the upper surface of the base plate 602 as shown in FIG. 10.

The cam bar 704 has a cross sectional profile with a short crosswise dimension being less than a height of the bearing assemblies 624 and 628, and a long crosswise dimension being equal to the height of the bearing assemblies 624 and 628. Rotating each actuator 702 correspondingly rotates the cam bars 704 between a supporting position in which the long crosswise dimension is vertically aligned, and a relaxed position in which the long crosswise dimension is rotated away from the vertical alignment. When in the supporting position, each cam bar 704 functions as a rigid support extending laterally across the upper surface of the base plate 602. In this orientation, the cam bars 704 each support a portion of the associated slip plates 608A, 608B and the longitudinally adjacent portion of the turn plate 610 between the bearing assembly 624 and the bearing assembly 628 against distortion or deflection under load. In the relaxed position, the cam bars 704 rest freely between the base plate 602, the slip plates 608A, 608B, and the turn plate 610, avoiding interference there with during translational and rotational movements. It will be recognized that specific construction of the cam bars 704 can be replaced by other support means to achieve the same functionality. For example, a supporting bar can be slid up a ramp by pulling on a lever or turning a screw, two parallel bars can be connected by a parallelogram linkage and actuated by a lever or a screw. Alternatively, a support means can be selectively raised by powered actuators, where the actuators are screws or pneumatic or hydraulic cylinders.

It will be recognized that by varying the structural materials, size and placement of the bearing assemblies 624 and 628, or by including additional bearing assemblies between the surfaces of the base plate 602, slip plates 608A, 608B, and turn plate 610, it may be possible to alter or eliminate the two-position anti-tip mechanisms 700 and still maintain the desired level tolerance for the assembly 600 under load. Alternatively additional anti-tip mechanisms 700 may be provided between the base plate 602 and the slip plate structure 608 and/or turn plate 610, depending upon the particular dimensions, structural rigidity, and precision tolerances of the assembly 600.

Each variant of the combined turn plate and slip plate assembly 100, 600 and the slip plate assembly 400 is manufactured with materials having sufficient strength and durability to withstand the anticipated vehicle loads applied during a vehicle service procedure, and to maintain the desired planar surfaces to within the established measurement tolerances. Exemplary materials for the manufacture include steel or other metals, and the various components and surfaces may be coated with corrosion resistant finishes as desired. Those of ordinary skill in the art will recognize that the specific materials and finishes employed in the construction of the assembly 600 may be varied as necessary to achieve a desired level of precision and structural rigidity without departing from the scope of the present disclosure.

As various changes could be made in the above constructions without departing from the scope of the disclosure, it is intended that all matter contained in the above description or shown in the accompanying drawings shall be interpreted as illustrative and not in a limiting sense.

The invention claimed is:

1. A combination slip plate and turn plate assembly for supporting steered wheels of a vehicle, comprising:

a slip plate structure supported on an underlying surface by at least one slip plate ball bearing assembly for at least two-axis translational movement parallel to said underlying surface;

a turn plate supported on said underlying surface by a turn plate ball bearing assembly for two-axis translational movement parallel to said underlying surface, and for rotational movement parallel to said underlying surface about a vertical axis;

wherein upper surfaces of said turn plate and said slip plate structure define a common planar surface; and wherein said slip plate and said turn plate are coupled for translational movement over said underlying surface.

2. The assembly of claim 1 further including a sideslip plate supported for lateral movement on an underlying surface by at least one bearing assembly, said sideslip plate disposed adjacent to an end of said slip plate, longitudinally opposite from said turn plate.

3. The assembly of claim 1 further including a tie rod having a limited range of lateral and longitudinal movement parallel to said underlying surface disposed between said slip plate structure and said underlying surface, and between said turn plate and said underlying surface;

wherein said turn plate is coupled to said tie rod via a first coupling; and wherein said slip plate structure is coupled to said tie rod via a plurality of couplings.

4. The assembly of claim 1 wherein said turn plate is supported by said turn plate ball bearing assembly on said underlying surface within a cutout region of said slip plate.

5. The assembly of claim 4 further including a first transverse support disposed between said underlying surface and a lower surface of both said turn plate and said slip plate adjacent to a first side of said turn plate ball bearing assembly relative to said vertical axis;

a second transverse support disposed between said underlying surface and said lower surface of both said turn plate and said slip plate adjacent to a second side of said turn plate ball bearing assembly on an opposite side of said vertical axis from said first transverse support; and wherein each of said first and second transverse supports are configured to maintain said upper surface of said turn plate and said upper surface of said slip plate in vertical alignment.

6. The assembly of claim 1 further including at least one support disposed between said underlying surface and a lower surface of both said turn plate and said slip plate structure, said at least one support configured to selectively support said turn plate and said slip plate structure in vertical alignment.

7. The assembly of claim 6 wherein said at least one support is an adjustable support disposed between said slip plate ball bearing assembly and said turn plate ball bearing assembly, said adjustable support configured with a first selectable position and a second selectable position;

wherein said adjustable support in said first selectable position is configured to engage and support a portion of said turn plate and a portion of said slip plate structure against vertical deflection; and wherein said adjustable support in said second selectable position is configured to disengage from said turn plate and said slip plate structure.

8. The assembly of claim 1 further including a position adjustment mechanism configured to enable movement of said underlying surface over a supporting surface.

9. The assembly of claim 8 wherein said underlying surface is a base plate disposed between said supporting surface and the slip plate and turn plate; and wherein said position adjustment mechanism includes a first set of retractable roller wheels disposed at a first longitudinal end of said base plate, and a second set of retractable roller wheels disposed at a second longitudinal end of said base plate opposite from said first longitudinal end.

10. The assembly of claim 1 wherein said slip plate structure includes a first slip plate supported on said underlying surface by a first slip plate ball bearing assembly and a second slip plate supported on said underlying surface by a second slip plate ball bearing assembly;

wherein said turn plate is supported on said underlying surface between said first and second slip plates by said turn plate ball bearing assembly;

wherein upper surfaces of said turn plate and said first and second slip plates define said common planar surface; and wherein a peripheral edge of each of said first and second slip plates is separated from said turn plate by an associated gap in said common planar surface.

11. The assembly of claim 10 wherein a cutout region separates said slip plate structure into said first and second independent slip plates, said cutout region defining at least a portion of said peripheral edges.

12. A combination slip plate and turn plate assembly for supporting steered wheels of a vehicle, comprising:

a slip plate supported on an underlying surface by at least one ball bearing assembly for two-axis translational movement parallel to said underlying surface;

a turn plate supported on said underlying surface by a second ball bearing assembly for two-axis translational movement parallel to said underlying surface, and for rotational movement parallel to said underlying surface about a vertical axis;

wherein an upper surface of said turn plate and an upper surface of said slip plate define a common planar surface; and further including a support disposed between said underlying surface and a lower surface of both said turn plate and said slip plate, said support configured to selectively support said upper surface of said turn plate and said upper surface of said slip plate in vertical alignment.

13. The assembly of claim 12 further including a sideslip plate supported for lateral movement on an underlying surface by at least one bearing assembly, said sideslip plate disposed adjacent to an end of said slip plate, longitudinally opposite from said turn plate.

14. The assembly of claim 12 wherein said slip plate includes first and second slip plate segments in a horizontally spaced configuration parallel to said underlying surface, each slip plate segment supported for said two-axis translational movement on said underlying surface by at least one associated ball bearing assembly; and wherein said turn plate is coupled linearly between said first and second slip plate segments.

15. A combination slip plate and turn plate assembly for supporting steered wheels of a vehicle, comprising:

a turn plate supported on an underlying surface for two-axis translational movement in a plane parallel to said underlying surface, said turn plate disposed linearly between a first slip plate segment and a second slip plate segment spaced apart within said plane, each of said first and second slip plate segments supported on said underlying surface for two-axis translational movement within said plane by an associated ball bearing assembly.

16. The assembly of claim 15 wherein said first and second slip plate segments are coupled together for synchronous two-axis translational movement in said plane parallel to said underlying surface.

17. The assembly of claim 16 wherein said turn plate is coupled to said first and second slip plate segments for synchronous translational moment over said underlying surface.

18. The assembly of claim 15 wherein said first slip plate segment and said second slip plate segment are configured to conform to a peripheral edge of said turn plate, and are separated from said turn plate by a gap.

19. The assembly of claim 15 wherein said first slip plate segment and said second slip plate segment are contiguous, and wherein said turn plate is disposed within a cutout region between said first and second slip plate segments.

* * * * *